US006719675B2

(12) United States Patent
Yu

(10) Patent No.: US 6,719,675 B2
(45) Date of Patent: Apr. 13, 2004

(54) INERTIAL ROCKING TYPE EXERCISING DEVICE

(75) Inventor: Hui-Nan Yu, Taoyuan (TW)

(73) Assignee: Jao-Hsing Tsai, Hsinchu (TW)

( * ) Notice: Subject to any disclaimer, the term of this patent is extended or adjusted under 35 U.S.C. 154(b) by 0 days.

(21) Appl. No.: 10/383,670

(22) Filed: Mar. 7, 2003

(65) Prior Publication Data

US 2003/0186790 A1 Oct. 2, 2003

(30) Foreign Application Priority Data

Mar. 29, 2002 (TW) ..... 91204158 U

(51) Int. Cl.[7] ..... A63B 21/22

(52) U.S. Cl. ..... 482/110; 482/62; 482/907; 482/905; 482/148

(58) Field of Search ..... 482/110, 62, 148, 482/907, 905, 96, 908, 140, 121–123, 129–130, 133–134, 139

(56) References Cited

U.S. PATENT DOCUMENTS 5,232,425 A * 8/1993 Miller et al. ..... 482/121
5,637,066 A * 6/1997 Chang ..... 482/126

* cited by examiner

*Primary Examiner*—Nicholas D. Lucchesi
*Assistant Examiner*—L Amerson
(74) *Attorney, Agent, or Firm*—Alan Kamrath

(57) ABSTRACT

A inertial rocking type exercising device includes a rotation main body, and a support rack. The rotation main body is provided with two semi-spherical bodies, and a rotation disk rotatably mounted on the two semi-spherical bodies. The rotation disk is provided with an extension portion for receiving a counterweight ball. The support rack is provided with two handles and has a first end inserted into one of the two semi-spherical bodies, and a second end provided with an arcuate catch plate. Thus, the inertial rocking type exercising device that has a small volume and can be assembled and dismantled easily and conveniently.

6 Claims, 5 Drawing Sheets

INERTIAL ROCKING TYPE EXERCISING DEVICE

BACKGROUND OF THE INVENTION

1. Field of the Invention

The present invention relates to an inertial rocking type exercising device, and more particularly to an inertial rocking type exercising device that has a small volume and can be assembled and dismantled easily and conveniently.

2. Description of the Related Art

A conventional body exercising device has a complicated construction, has a large volume, and occupies much space, so that the conventional body exercising device cannot be moved, folded and stored easily and conveniently.

SUMMARY OF THE INVENTION

The primary objective of the present invention is to provide an inertial rocking type exercising device that has a small volume and can be assembled and dismantled easily and conveniently.

In accordance with the present invention, there is provided an inertial rocking type exercising device, comprising a rotation main body, and a support rack, wherein:

the rotation main body is provided with two semi-spherical bodies which are combined with each other, a rotation disk is mounted on the two semi-spherical bodies, the rotation disk is formed with an arcuate concave portion for receiving the two semi-spherical bodies, so that the rotation disk may be rotated with variation of different angles, the rotation disk has an outer periphery provided with an extension portion which receives at least one counterweight ball therein; and the support rack has a cross-shape, and has a first end formed with an insertion portion inserted into one of the two semi-spherical bodies, and a second end provided with an arcuate catch plate, the support rack has two sides each formed with a handle insertion hole for insertion of a handle.

Further benefits and advantages of the present invention will become apparent after a careful reading of the detailed description with appropriate reference to the accompanying drawings.

DETAILED DESCRIPTION OF THE INVENTION

Figure 1:
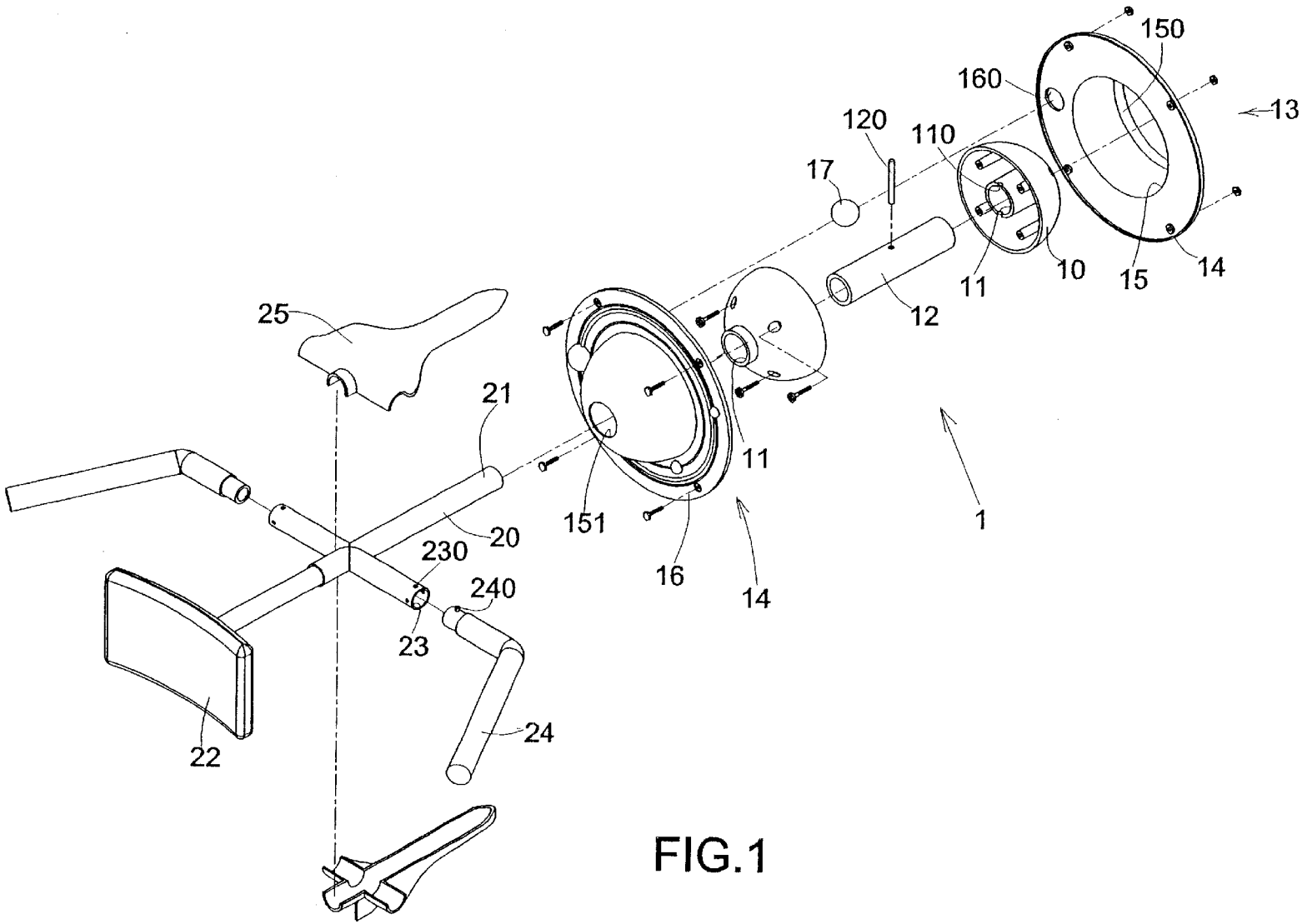
FIG. 1 is an exploded perspective view of an inertial rocking type exercising device in accordance with a preferred embodiment of the present invention.
Figure 2:
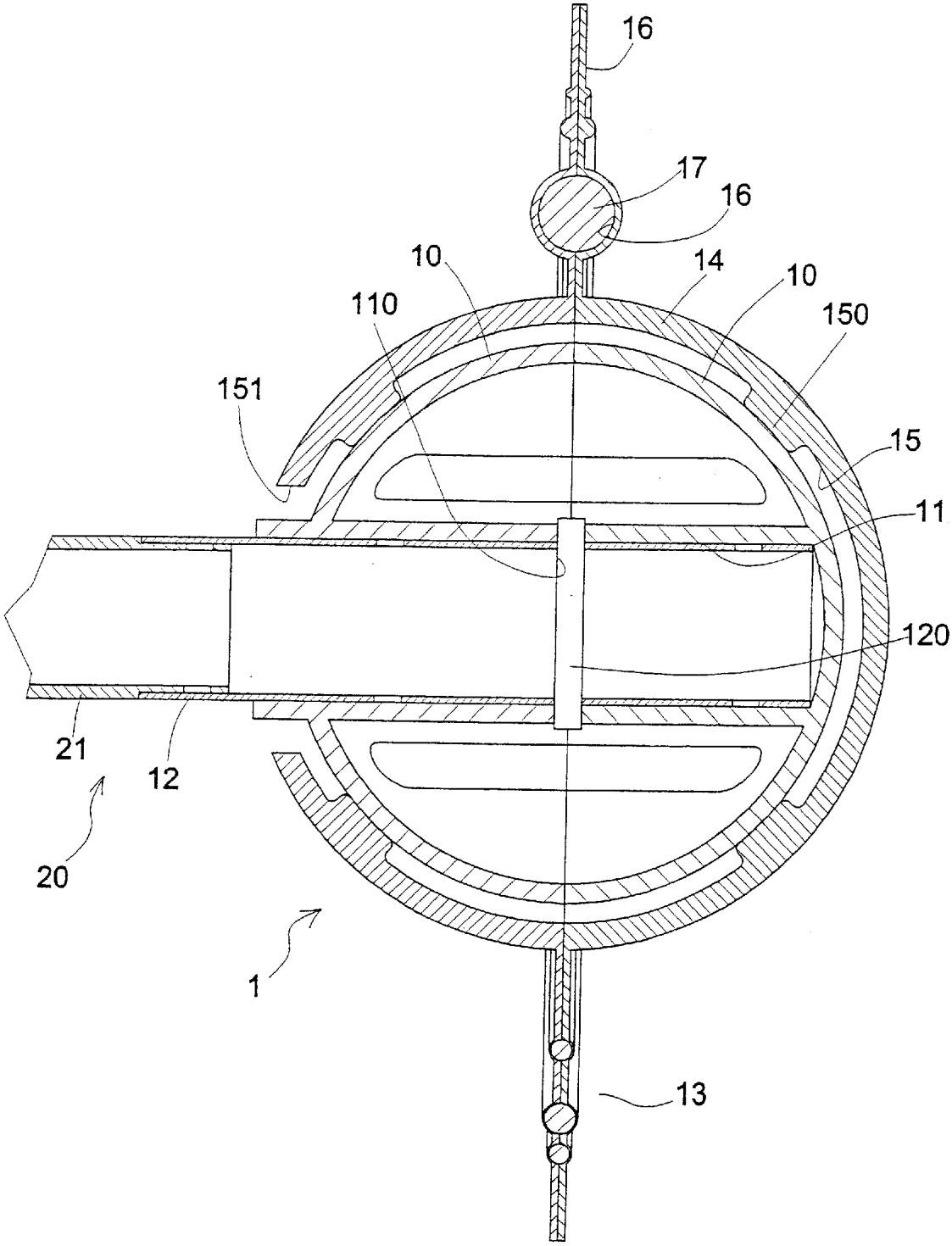
FIG. 2 is a side plan cross-sectional assembly view of the inertial rocking type exercising device as shown in FIG. 1.

Referring to the drawings and initially to FIGS. 1 and 2, an inertial rocking type exercising device in accordance with a preferred embodiment of the present invention comprises a rotation main body 1, and a support rack 20.

The rotation main body 1 is provided with a shaft 12. The shaft 12 has a mediate portion provided with a radially directed positioning post 120 whose two ends protrude outward from an outer wall of the shaft 12.

The shaft 12 is provided with two semi-spherical bodies 10 which are combined with each other. Each of the two semi-spherical bodies 10 has a center provided with a shaft hole 11 for passage of the shaft 12. The shaft hole 11 of one of the two semi-spherical bodies 10 is extended to an outside, so that one end of the shaft 12 protrudes outward from one of the two semi-spherical bodies 10. The shaft hole 11 of each of the two semi-spherical bodies 10 is formed with an insertion recess 110 for insertion of the positioning post 120.

A rotation disk 13 having a shape of the Saturn is mounted on the two semi-spherical bodies 10, and includes two casings 14 which are combined with each other. Each of the two casings 14 is formed with an arcuate concave portion 15 for receiving each of the two semi-spherical bodies 10. The arcuate concave portion 15 of each of the two casings 14 is provided with multiple protruding bars 150 each having an arcuate face that may be rested on an outer wall of each of the two semi-spherical bodies 10, so that the rotation disk 13 may be rotated on the two semi-spherical bodies 10. The arcuate concave portion 15 of one of the two casings 14 is formed with a through hole 151 for passage of the shaft 12. Each of the two casings 14 has an outer periphery provided with an annular extension portion 16 which is formed with at least one cavity 160 for receiving a counterweight ball 17.

The support rack 20 has a cross-shape, and has a first end formed with an insertion portion 21 inserted into the shaft 12 in the two semi-spherical bodies 10, and a second end provided with an arcuate catch plate 22 that may be rested on the user's abdomen. A shade 25 having the shape of a flight vehicle is mounted on the support rack 20. The support rack 20 has two sides each provided with a handle 24. Each of the two sides of the support rack 20 is formed with a handle insertion hole 23 for insertion of a distal end of the handle 24. The handle insertion hole 23 has a periphery formed with multiple positioning holes 230, and the distal end of the handle 24 is provided with a protruding stub 240 that may be positioned in one of the multiple positioning holes 230.

In assembly, the rotation disk 13 is mounted on the two semi-spherical bodies 10, and each of the two casings 14 is formed with an arcuate concave portion 15 for receiving each of the two semi-spherical bodies 10. The arcuate concave portion 15 of each of the two casings 14 is provided with multiple protruding bars 150 each having an arcuate face that may be rested on the outer wall of each of the two semi-spherical bodies 10, so that the rotation disk 13 may be rotated on the two semi-spherical bodies 10 with variation of different angles.

Each of the two casings 14 has an outer periphery provided with an annular extension portion 16 for receiving the counterweight ball 17. Thus, the user's two hands may hold the two handles 24 with the arcuate catch plate 22 being rested on the user's abdomen, thereby forming a support.

Figure 3:
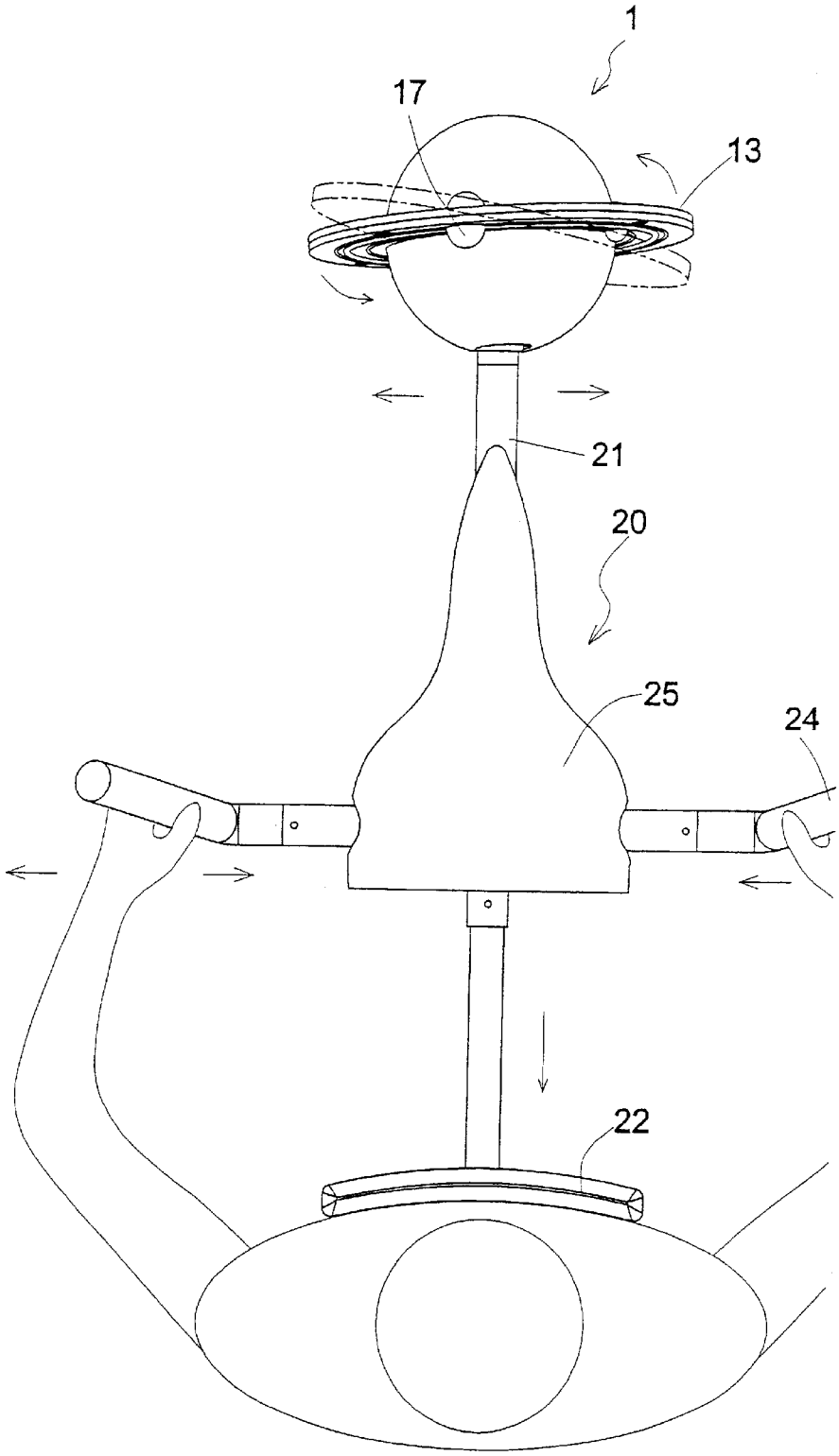
FIG. 3 is a schematic top plan operational view of the inertial rocking type exercising device as shown in FIG. 1.
Figure 5:
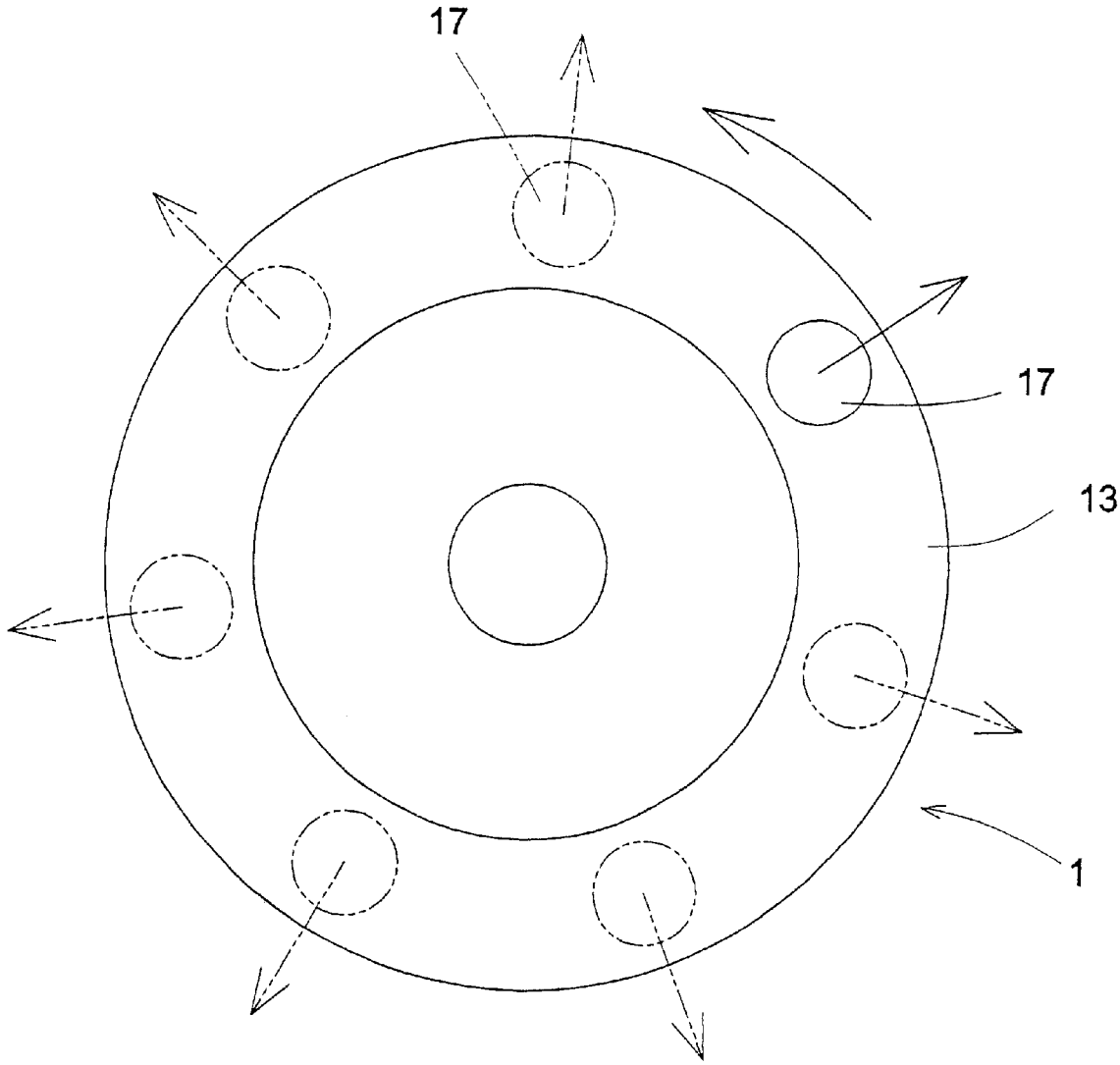
FIG. 5 is a schematic top plan operational view of a rotation main body of the inertial rocking type exercising device as shown in FIG. 1.

In operation, the user may swing his waist and rock his two hands so as to shake the two handles 24 as shown in FIG. 3, so that the counterweight ball 17 of the rotation disk 13 on the support rack 20 may produce an inertial force, to drive the rotation disk 13 to rotate on the two semi-spherical bodies 10. During rotation of different angles of the rotation disk 13, the counterweight ball 17 may produce centrifugal forces of various different angles as shown in FIG. 5, so that the user's two hands and abdomen will withstand the centrifugal forces of various different angles produced by the counterweight ball 17 during rotation of different angles of the rotation disk 13, thereby efficiently exercising the user's two hands and abdomen. In addition, the user has to swing his waist and rock his two hands continuously, so that the counterweight ball 17 may produce centrifugal forces of various different angles to rotate the rotation disk 13, thereby enhancing the exercising effect. The support rack 20 may be detached from the rotation main body 1, and the two handles 24 may be detached from the support rack 20, so that the exercising device may be folded and stored easily and conveniently.

Figure 4:
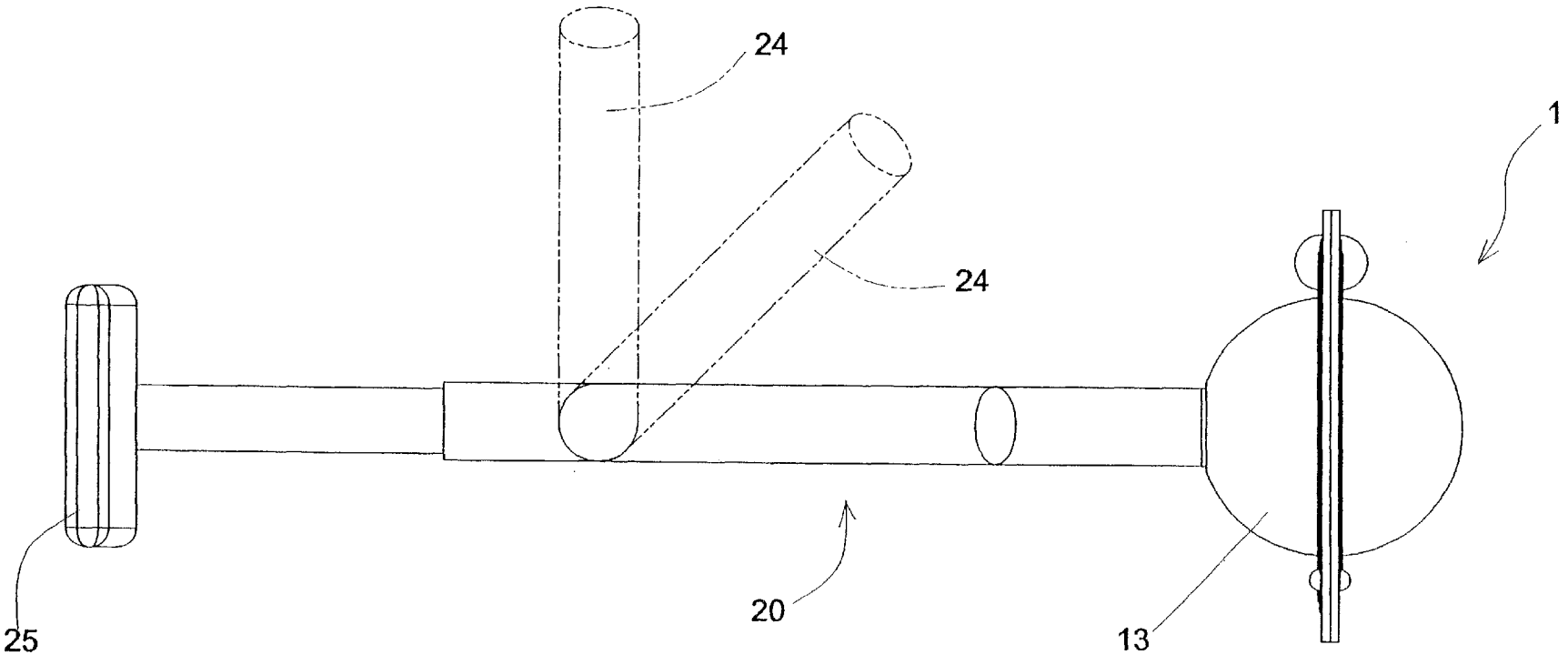
FIG. 4 is a schematic top plan operational view of a support rack of the inertial rocking type exercising device as shown in FIG. 1.

Further, the protruding stub 240 of the distal end of the handle 24 may be locked and positioned in one of the multiple positioning holes 230, so that the two handles 24 may be disposed at different inclined angles as shown in FIG. 4, and the user may exercise the muscle of different portions by adjusting the inclined angles of each of the two handles 24.

In addition, the rotation disk 13 of the rotation main body 1 is formed of the shape of the Saturn, and the counterweight ball 17 in the extension portions 16 of the rotation disk 13 is like a planet beside the Saturn, thereby proving an amusement effect during rotation of the rotation disk 13.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An inertial rocking type exercising device, comprising a rotation main body, and a support rack, wherein:

the rotation main body is provided with two semi-spherical bodies which are combined with each other, a rotation disk is mounted on the two semi-spherical bodies, the rotation disk is formed with an arcuate concave portion for receiving the two semi-spherical bodies, so that the rotation disk may be rotated with variation of different angles, the rotation disk has an outer periphery provided with an extension portion which receives at least one counterweight ball therein; and the support rack has a cross-shape, and has a first end formed with an insertion portion inserted into one of the two semi-spherical bodies, and a second end provided with an arcuate catch plate, the support rack has two sides each formed with a handle insertion hole for insertion of a handle.

2. The inertial rocking type exercising device in accordance with claim 1, wherein the rotation main body is provided with a shaft mounted in each of the two semi-spherical bodies, and the shaft has one end protruding outward from the rotation disk.

3. The inertial rocking type exercising device in accordance with claim 1, wherein the handle insertion hole of the support rack has a periphery formed with multiple positioning holes, and the handle is provided with a protruding stub that may be positioned in one of the multiple positioning holes.

4. The inertial rocking type exercising device in accordance with claim 1, wherein the rotation disk includes two casings which are combined with each other, each of the two casings is provided with an arcuate concave portion which is provided with multiple protruding bars each rested on an outer wall of each of the two semi-spherical bodies.

5. The inertial rocking type exercising device in accordance with claim 4, wherein one of the two casings of the rotation disk is formed with a through hole directed toward the support rack for passage of a shaft.

6. The inertial rocking type exercising device in accordance with claim 1, wherein the extension portion of the rotation disk is formed with at least one cavity for receiving the counterweight ball.

* * * * *